US006536170B2

(12) United States Patent
Stuever

(10) Patent No.: US 6,536,170 B2
(45) Date of Patent: Mar. 25, 2003

(54) MANUFACTURED HOME FOUNDATION

(76) Inventor: Joseph H. Stuever, 402 S. 17th, Guthrie, OK (US) 73044

( * ) Notice: Subject to any disclaimer, the term of this patent is extended or adjusted under 35 U.S.C. 154(b) by 0 days.

(21) Appl. No.: 09/759,874

(22) Filed: Jan. 12, 2001

(65) Prior Publication Data

US 2002/0092250 A1 Jul. 18, 2002

(51) Int. Cl.[7] ..... E02D 27/00

(52) U.S. Cl. ..... 52/299; 52/274; 52/294; 52/169.9

(58) Field of Search ..... 52/169.12, 274, 52/294, 295, 299, 741.15, DIG. 11, 169.9, 298, DIG. 3

(56) References Cited

U.S. PATENT DOCUMENTS

| | | | | | |
|---|---|---|---|---|---|
| 2,542,859 | A | | 2/1951 | Clements | |
| 3,106,411 | A | | 10/1963 | Holmes | |
| 3,279,132 | A | | 10/1966 | Slayter | |
| 3,478,482 | A | | 11/1969 | Weir | |
| 3,706,168 | A | | 12/1972 | Pilish | |
| 3,724,151 | A | | 4/1973 | Kaywood et al. | |
| 3,791,087 | A | | 2/1974 | Sigal | |
| 3,802,134 | A | | 4/1974 | McCorvey | |
| 3,802,138 | A | | 4/1974 | McCarter | |
| 3,830,024 | A | | 8/1974 | Warnke | |
| 3,879,905 | A | * | 4/1975 | Catalano, Sr. | 52/23 |
| 3,882,218 | A | | 5/1975 | Bixel, Jr. | |
| 3,916,587 | A | | 11/1975 | Cox | |
| 3,921,356 | A | | 11/1975 | Hughes | |
| 4,007,568 | A | * | 2/1977 | Soble | 52/294 |
| 4,009,542 | A | | 3/1977 | Houston | |
| 4,010,584 | A | | 3/1977 | Banrnes, Jr. | |
| 4,064,668 | A | | 12/1977 | Carter | |
| 4,107,888 | A | | 8/1978 | Krueger | |
| 4,222,208 | A | | 9/1980 | Ferver | |
| 4,329,826 | A | | 5/1982 | Flogaus et al. | |
| 4,472,916 | A | | 9/1984 | Krebs | |
| 4,517,781 | A | * | 5/1985 | LeBlanc | 52/299 |
| 4,546,581 | A | | 10/1985 | Gustafson | |
| 4,560,131 | A | | 12/1985 | Eck | |
| 4,656,797 | A | | 4/1987 | Marquart | |
| 4,738,061 | A | | 4/1988 | Herndon | |
| 4,793,110 | A | | 12/1988 | Tucker | |
| 4,841,691 | A | | 6/1989 | Stoecker | |
| 4,899,497 | A | | 2/1990 | Madl, Jr. | |
| 4,976,077 | A | | 12/1990 | Tucker | |
| 5,146,724 | A | * | 9/1992 | Angelo | 52/299 |
| 5,152,108 | A | | 10/1992 | Madl, Jr. | |
| 5,224,311 | A | | 7/1993 | Pearce | |
| 5,363,610 | A | | 11/1994 | Thomas et al. | |
| 5,561,950 | A | | 10/1996 | Collins et al. | |
| 5,657,597 | A | | 8/1997 | Loftus | |
| 5,664,377 | A | | 9/1997 | Angelo et al. | |
| 5,678,382 | A | | 10/1997 | Naito | |
| 5,685,115 | A | | 11/1997 | Colfer | |
| 5,870,866 | A | | 2/1999 | Herndon | |
| 5,953,874 | A | | 9/1999 | Hoffman et al. | |
| 5,987,827 | A | | 11/1999 | Lord | |
| 6,009,674 | A | | 1/2000 | Root | |
| 6,032,421 | A | | 3/2000 | Yamada | |
| 6,094,873 | A | | 3/2000 | Hoffman et al. | |
| 6,125,597 | A | * | 10/2000 | Hoffman et al. | 52/169.12 |

* cited by examiner

*Primary Examiner*—Carl D. Friedman
*Assistant Examiner*—Brian E. Glessner
(74) *Attorney, Agent, or Firm*—Dunlap, Codding & Rogers, P.C.

(57) ABSTRACT

A foundation system for a manufactured home utilizing a plurality of elongated footings extending transversely of the home and support blocks which may be pushed along the footings into proper position for attachment to the structural beams of the manufactured home.

7 Claims, 7 Drawing Sheets

MANUFACTURED HOME FOUNDATION

FIELD OF THE INVENTION

This invention relates to foundation systems, and more particularly, a foundation system for manufactured homes.

BACKGROUND OF THE INVENTION

Manufactured homes historically have been susceptible to high winds. A great variety of systems have been devised and utilized for anchoring manufactured homes in an effort to prevent a manufactured home from being turned over by a high wind. Typical systems include mechanical tie-downs which are, at least generally speaking, inadequate and difficult to properly install. Furthermore, when a manufactured home is simply mounted on concrete blocks, which is typical, and anchored by mechanical tie-downs, the home does not meet the specifications for what are considered the most desirable home loans.

SUMMARY OF THE INVENTION

The present invention contemplates a plurality of footings imbedded in the ground in parallel, spaced apart relation arranged to extend transversely with respect to the length of the manufactured home to be supported. A plurality of support blocks are slidingly mounted on the footings in such a manner that the support blocks can be pushed underneath the manufactured home into an accurate position underneath the usual structural beams extending lengthwise underneath the manufactured home. Suitable fasteners are then secured to the support blocks and the structural beams and the support blocks are adequately secured to the footings, such that the manufactured home will be securely supported against high winds. Further, the invention contemplates the use of skirting around the lower edge of the manufactured home to provide a crawl space underneath the manufactured home and provide an appearance similar to a more conventionally constructed home.

DETAILED DESCRIPTION OF A PREFERRED EMBODIMENT

Figure 1:
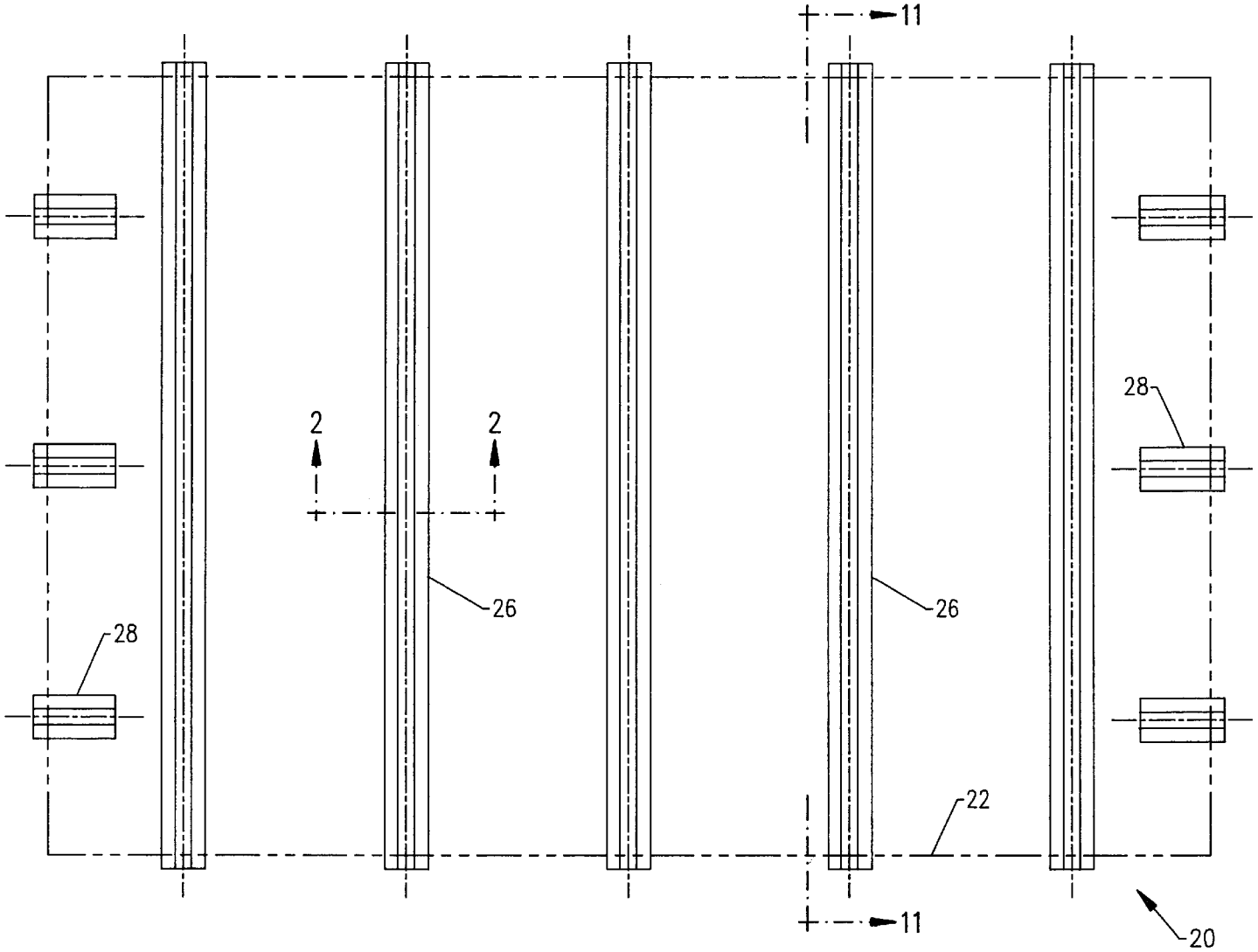
FIG. 1 is a plan view of the footing arrangement of the present invention showing the relationship of the footings with respect of the manufactured home.
Figure 5:
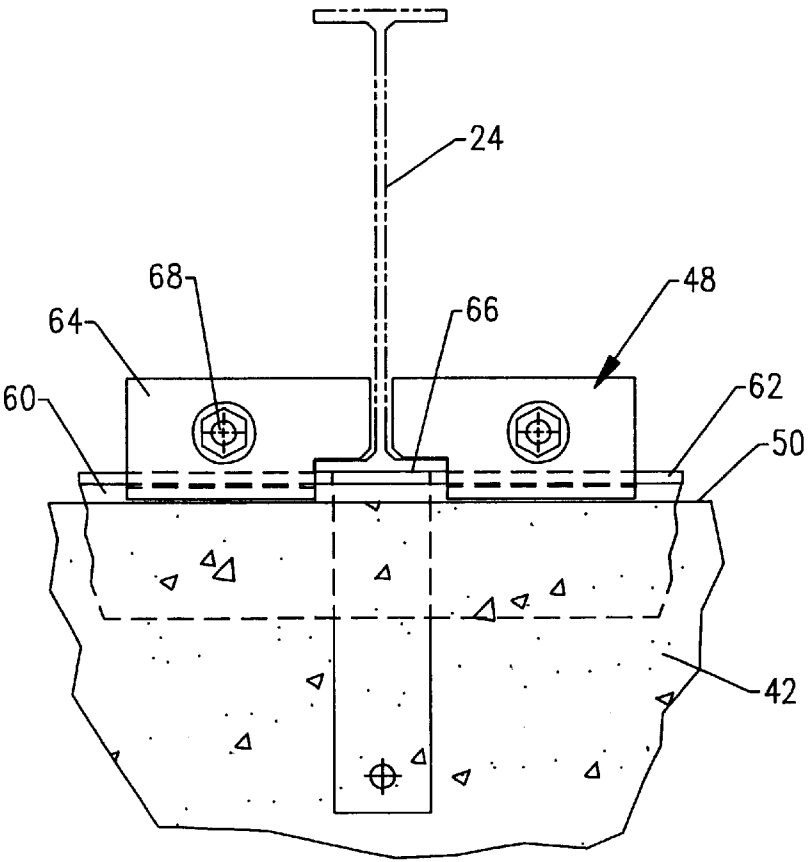
FIG. 5 is an enlarged cross sectional view looking at a right angle to the structure shown at the top of FIG. 4.

Referring to the drawings in detail, and particularly FIG. 1, reference character 20 generally designates a foundation system for a manufactured home 22 which is shown in dashed lines in FIG. 1. A typical manufactured home has two or more structural support beams extending lengthwise along the bottom of the home. A typical manufactured home support beam is in the form of an I-beam 24 as shown most clearly FIG. 5. Such I-beams 24 are located underneath the manufactured home and extend lengthwise of the manufactured home from one end to the other. The present foundation system 20 is designed to support such I-beams 24 and be securely attached thereto in order to make the manufactured home 22 wind resistant.

The foundation system 20 includes a plurality of elongated footings 26 arranged in a parallel relationship extending transversely with respect to the manufactured home support beams. As indicated in FIG. 1, each footing 26 has a length slightly eater than the width of the ma factured home 22 to project outside of the dimensions of the manufactured home 22. For example, a typical manufactured home may have a width of 28 feet and 2 inches and each footing may have a length of 29 feet, such that the end of each footing 26 would project approximately 5 inches beyond the side of the manufactured home. When skirting is utilized, the foundation system 20 also includes shorter footings 28 adjacent each end of the manufactured home 22 for use in supporting skirting along each end of the manufactured home, as will be described in detail below.

Figure 2:
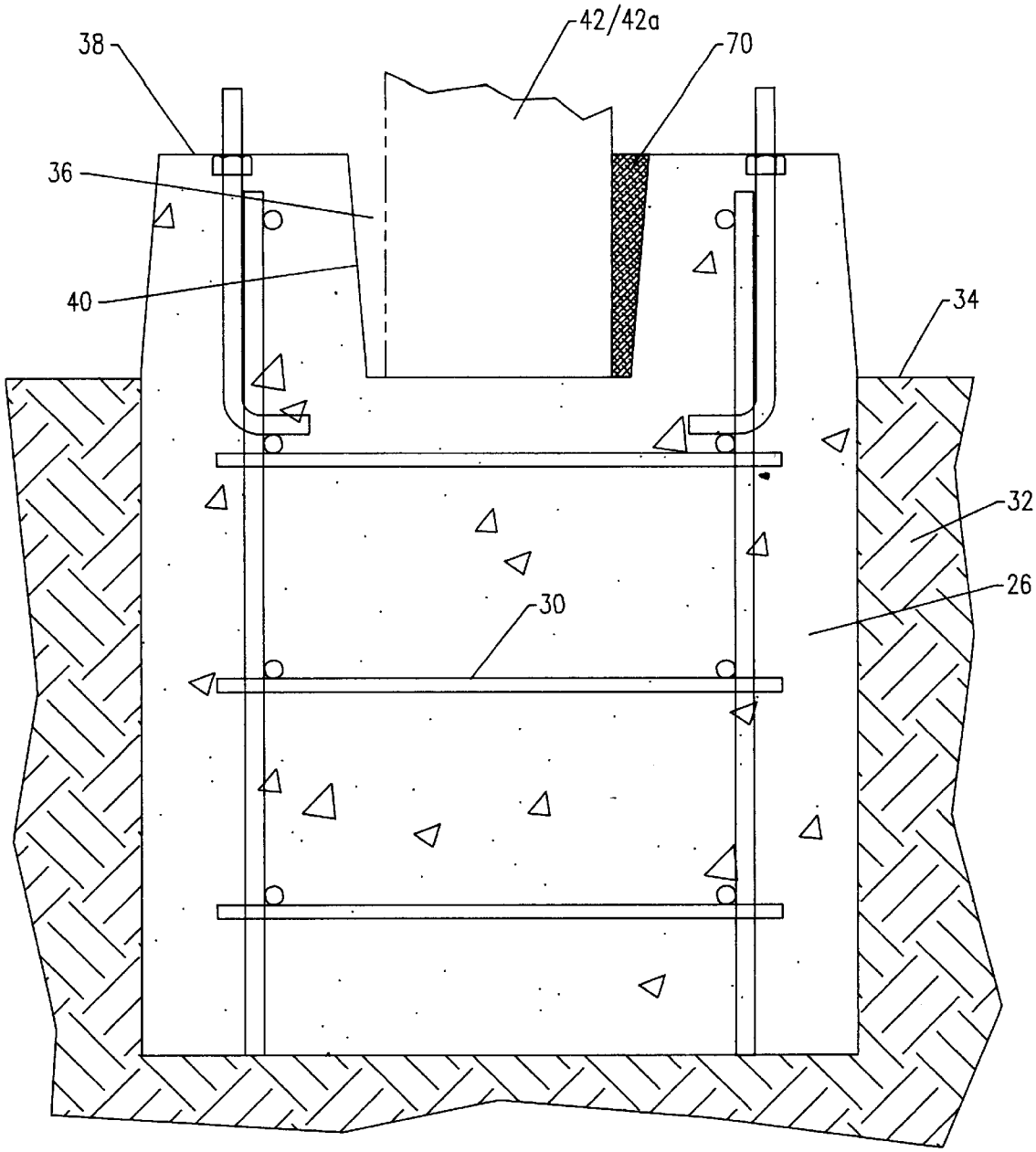
FIG. 2 is an enlarged cross sectional view of one of the footings as taken along the lines 2—2 of FIG. 1.

Each footing 26 (FIG. 2) is formed of concrete suitably reinforced by bars 30 to provide a strong structure. Each footing is buried in the ground 32 in such a manner as to extend only a few inches above the top surface 34 of the ground as shown in FIG. 2. A groove 36 is provided in the top 38 of each footing 26 and extends along the length of the footing. The side walls 40 of each groove 36 are tapered downwardly and inwardly as also illustrated in FIG. 2.

The present system 20 also utilizes a plurality of support blocks 42 shown in FIGS. 3, 4, 5 and 6. Each support block 42 is suitably reinforced concrete (re: enforcing shown in dash lines in FIG. 3) and typically is of a weight approximately 700 pounds. Each support block 42 is rectangularly shaped, having essentially straight vertically side walls 44, a straight or flat bottom 46 and carries a fastener generally indicated at 48 near the upper end 50 thereof. The tener 48 is not only secured to the block 42 but is designed to be attached to one of the structural beams 24 of the manufactured home in such a manner that if a high wind attempts to lift the manufactured home, it will also have to lift the support blocks 42.

A suitable fastener 48 (FIGS. 5 and 6) comprises a pair of angle irons 60 imbedded in the top 50 of each support block 42 where the upper flange 62 of each angle iron 60 is spaced slightly above the top 50 of the support block 42. The typical fastener 48 also employs additional angle irons 64 having one flange thereof positioned underneath the horizontal flange 62 of an adjacent angle iron 60, with each angle iron 64 being cut away to extend over the bottom flange 66 of one of the structural I-beams 24. The adjacent angle irons 64 at each side of the support block 42 are in turn secured together by bolts 68. Thus, the fastener 48 securely attaches the respective I-beam 24 to the respective support block 42.

Figure 12:
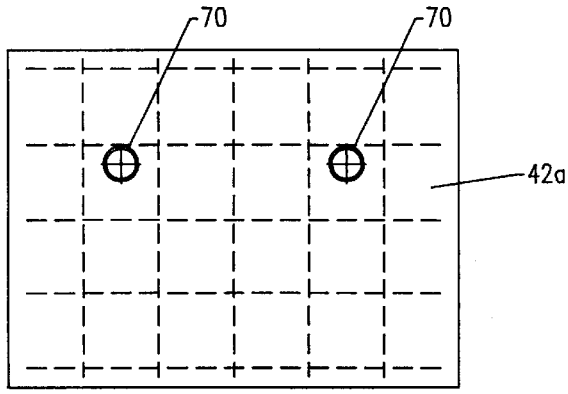
FIG. 12 is a side view of another form of support block.
Figure 3:
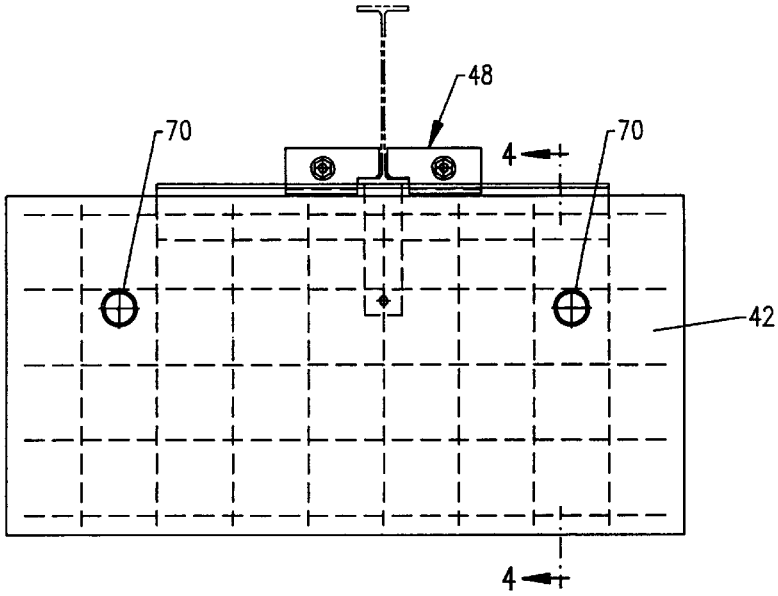
FIG. 3 is a side view of one of the types of support blocks.
Figure 4:
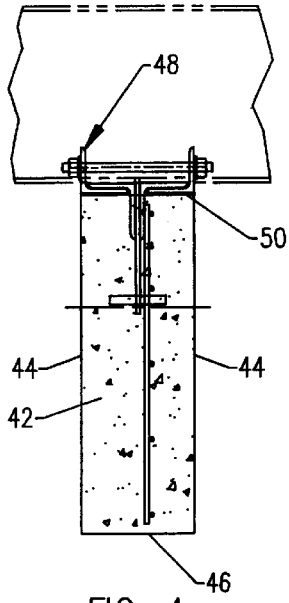
FIG. 4 is cross sectional view of a support block as taken along lines 4—4 of FIG. 3, with the metal structural members shown in elevation for clarity of illustration.
Figure 6:
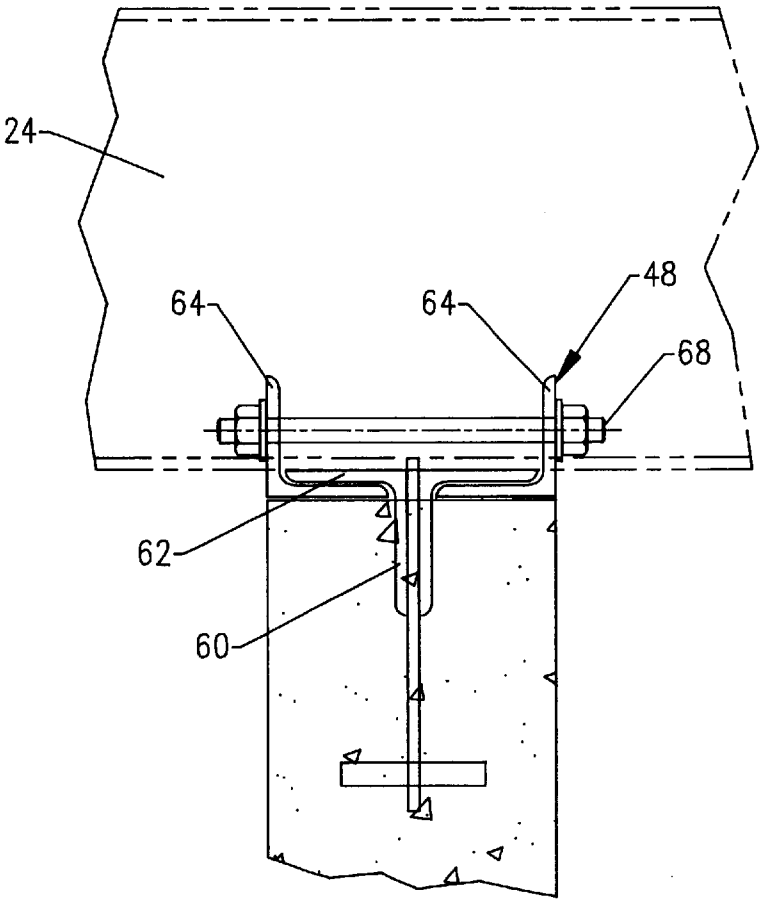
FIG. 6 is an enlarged cross sectional view of the upper portion of FIG. 4.

In use of the present system, each of the support blocks 42 is pushed along one of the footings 26, by sliding through the respective groove 36 (FIG. 2) until the respective support block 42 is positioned underneath one of the I-beams 24 of the manufactured home 22 as schematically illustrated in FIG. 12. With the respective I-beam resting on the respective angle iron flange 62, the attachment 48 carried by the respective support block 42 is then secured to the respective I-beam 24 in the manner described above. Where-upon, a suitable grout 70 is then placed in the groove 36 in the space provided between the support block 42 and the side walls 40 of the groove 36 to securely fasten the support block 42 to the respective footing 26. With this arrangement, the mobile home will be anchored to the footings 26, not only for adequate support, but also for adequate wind resistance.

As previously indicated, when skirting is desired, the additional shorter footings 28 (FIG. 1) are provided at each end of the manufactured home 22. Each shorter footing 28 would typically be 3 feet long for a manufactured home of the size previously discussed, and, typically, three of the shorter footings 28 would be provided as shown in FIG. 1 at each end of the foundation system 20. Each short footing 28 has a cross sectional configuration the same as a footing 26 as illustrated in FIG. 2.

Each shorter footing 28 receives a support block 42*a* illustrated in FIG. 12. Each support block 42*a* is rectangular in configuration the same as a support block 42, but does not have a fastener at the top thereof. Each support block 42*a* has a pair of pipes 70 imbedded therein to extend transversely thru the support block for the receipt of other fasteners as will be described below. Each support block 42*a* will be supported in the mating groove 36 of the respective shorter footing 28 and then grouted therein in the same manner as previously described with respect to the support blocks 42.

Figure 9:
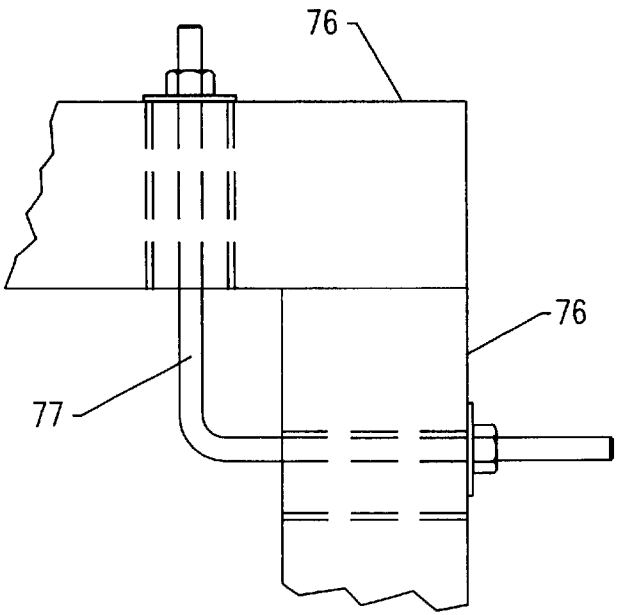
FIG. 9 is a plan view of a typical skirting connection used at the corner of a manufactured home.
Figure 11:
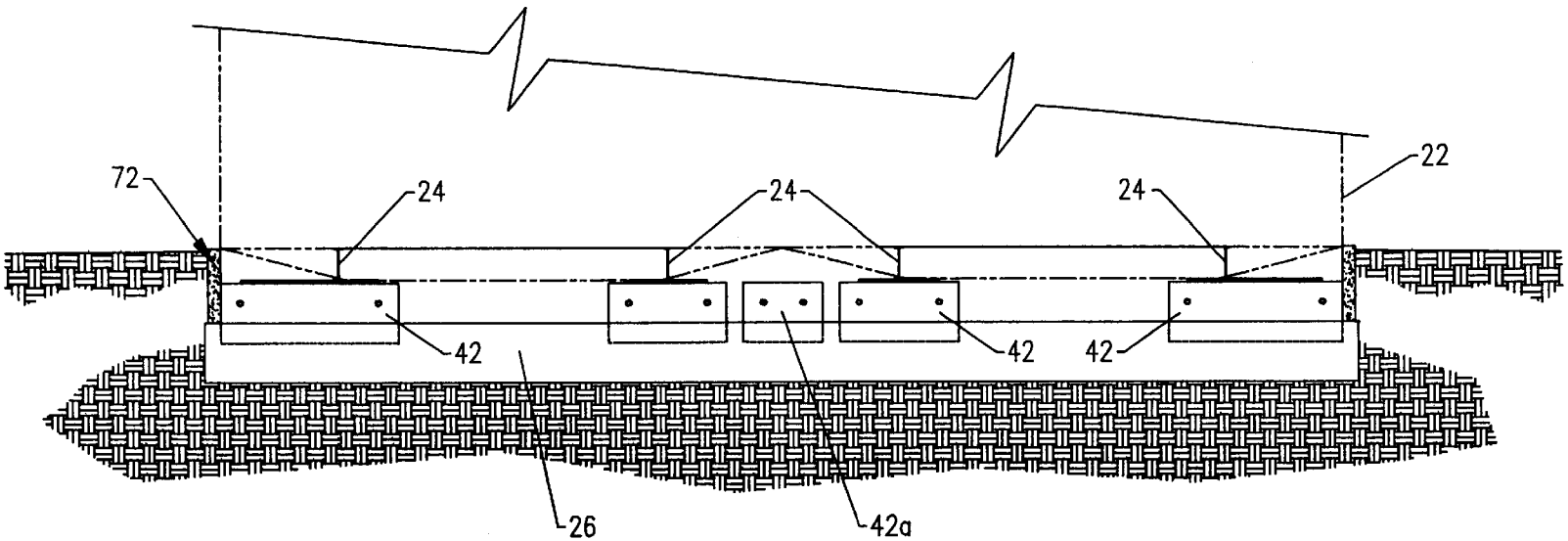
FIG. 11 is a schematic cross sectional view take long lines 11—11 of FIG. 1 showing a typical location of support blocks underneath a manufactured home.

The skirting, generally indicated at 72, is show hematically in FIG. 11 and in detail in FIGS. 7–10. The skirting will normally be formed in panels 74 of reinforced concrete, but may also include panels 76 as shown in FIG. 9 in the form of an L-shape to fit at the corners of the manufactured home. As shown in FIG. 9, the adjacent ends of the corner panels 76 are secured in abutting relation by L-shaped bolts 77. Height-wise, the skirting 72 extends from the tops of the footings 26 and 28 to at least the lower edge of the outside wall of the manufactured home 22 to totally enclose the space provided underneath the manufactured home. Soil would then normally be pushed against the outside surfaces of the skirting 72 up to about the height of the level of the bottom of the manufactured home to give the appearance of a conventionally constructed home.

Figure 7:
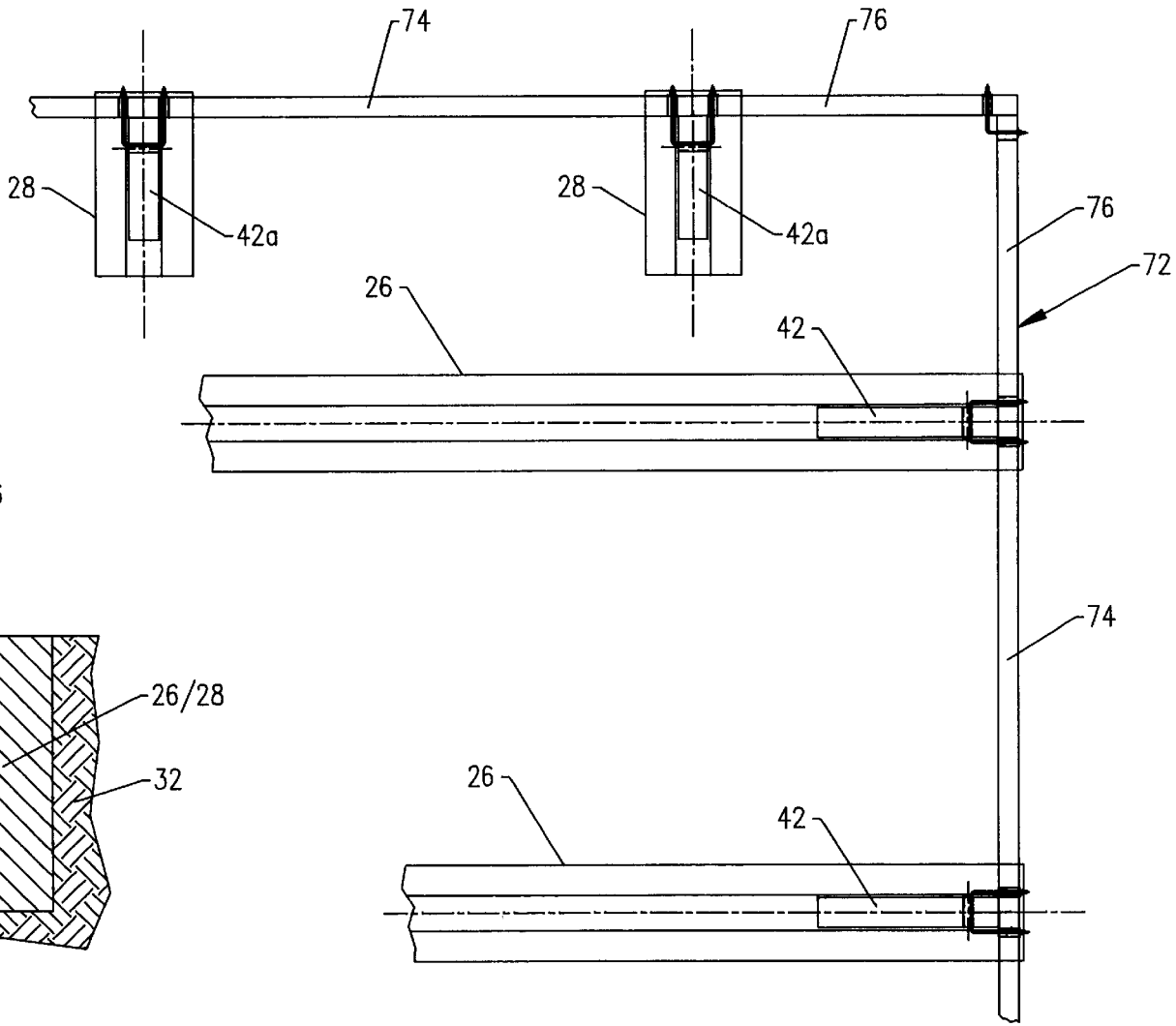
FIG. 7 is a partial plan view of a portion of the skirting shown attached to some of the support blocks.
Figure 8:
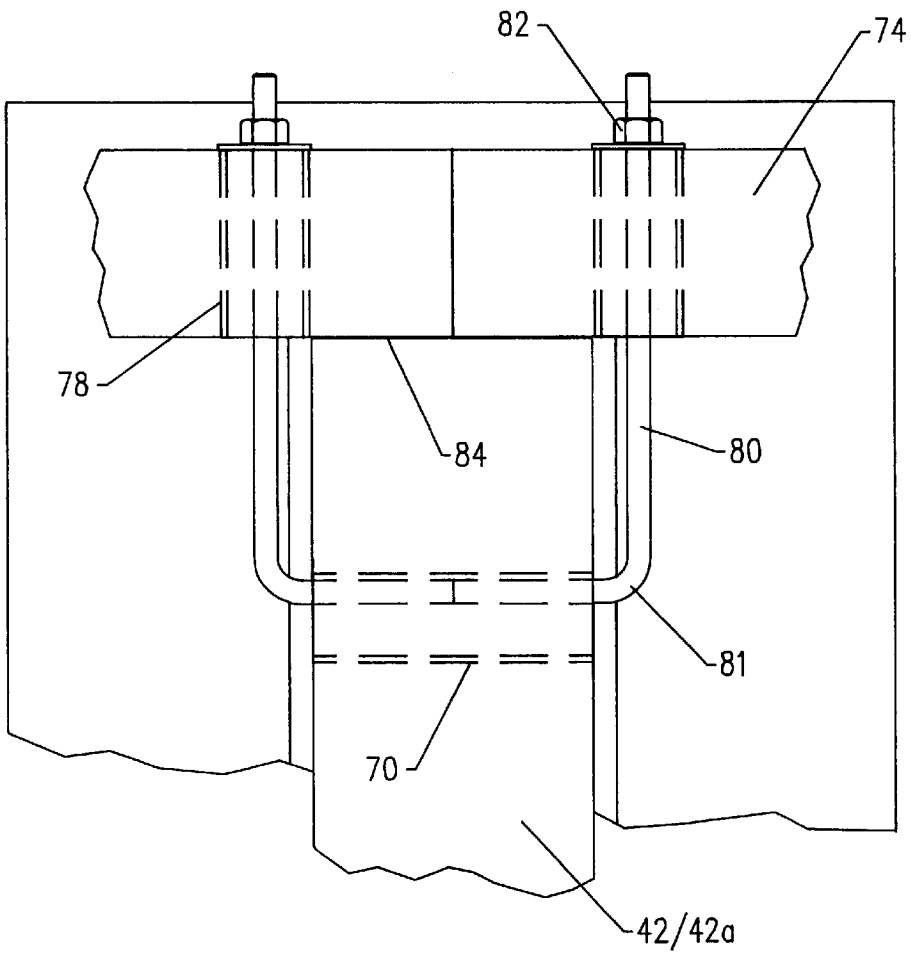
FIG. 8 is an enlarged detailed view of a typical connection of the skirting to a support block.
Figure 10:
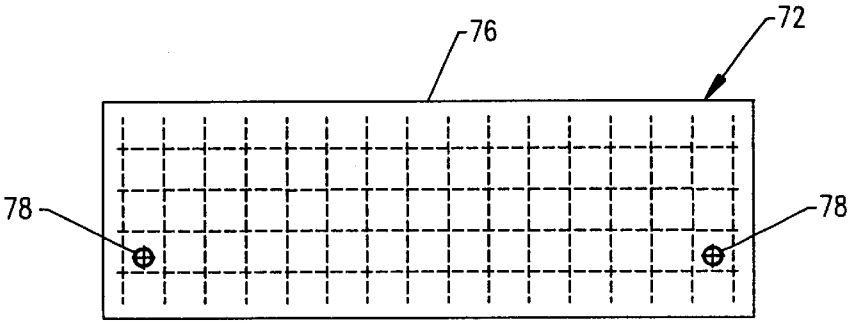
FIG. 10 is a side view of a typical panel of skirting.

Each end of each panel 74 of the skirting 72 is provided with an apperature 78 to receive the end of a U-bolt 80 as illustrated in FIG. 8. The base portion 81 of each U-bolt 80 extends through one of the pipes 70 in the respective support block 42 or 42*a*. A suitable nut and washer 82 are then secured on the outer end of each leg of the U-bolt 80 to force the respective panels 74 against the end 84 of the respective support block 42 or 42*a*. A partial assembly of paneling is shown in FIG. 7 to provide a more thorough illustration.

In a preferred shod of installation of the prezt foundation system, the footings 26 and 28 are first placed in the ground 32 such that the upper ends of the footings extend a very short distance above the top 34 of the ground 32. These supports may poured in place or manufactured separately and installed in the ground. In any event, the footings 26 and 28 will be sized and placed in the ground such a distance that the tops of the footings will be level.

The manufactured home will then normally be pulled over the footings 26 and 28 into the position shown in FIG. 1. The support blocks 42 are then shoved along the respective footings 26 until the attachment 48 of each support block is properly positioned with respect to the respective support beam 24. The manufactured home is then lowered until the structural beams 24 of the manufactured home rest on the upper surfaces of the angle irons 60 on the support blocks 42. The attachments 48 are then secured to the beams 24. At such time, grout 70 will be placed in each of the grooves 36 of the respective footings 26 to secure the support blocks 42 in the footings 26.

As shown in FIG. 11, a typical double-wide manufactured home 22 will have four I-beams 24, two with each half of the home. In this arrangement, the inner-most two support blocks 42 may be shorter than the outer support block 42, since they are not used to support the skirting 72. Also, a support block 42*a* may be placed on each footing 26 underneath the center of the home where the two halves of the home are joined and to support that portion of the house.

The shorter support blocks 42*a* are then inserted in the respective grooves of the shorter footings 28 into the positions shown in FIG. 7; whereupon the various panels 74 and 76 of the skirting 72 are placed in position and secured by use of the bolts 77 and J-Bolts 80 as shown in FIGS. 8 and 9. As mentioned above, soil may pushed up against the skirting 72 to the height desired to provide an appealing appearance and the appearance of a conventionally constructed home.

Figure 13:
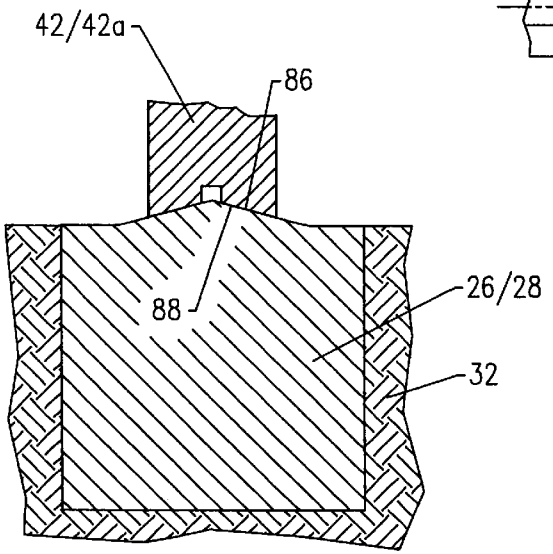
FIG. 13 is a schematic cross sectionl view of a modified footing and support block joint.

In the embodiments described above, the lower portion of each support block effectively forms a tongue which fits in the respective groove 36 in the upper surface of the respective footing 26 or 28. In lieu thereof, the lower end of each support block 42 and 42*a* may be grooved as indicated at 86 in FIG. 13 and the top of each footing 26 or 28 may be shaped as a tongue indicated at 88. In either arrangement, the support blocks 42 and 42*a* can be pushed along the respective footing 26 or 28 to the desired position.

Changes may be made in the combination and arrangement of parts or elements and in steps or procedures set forth above without departing from the spirit and scope of the invention as defined in the following claims:

What is claimed is:

1. A foundation system for a manufactured home having at least two support beams thereunder extending lengthwise along the manufactured home, comprising;

a plurality of elongated footings arranged in parallel, spaced apart relationship under the manufactured home extending substantially at right angles to the manufactured home support beams;

a pair of support blocks positionally secured on each footing with each support block being under one of the support beams of the manufactured home;

a fastener carried by each support block secured to the support block and the respective support beam of the manufactured home; and a tongue and groove connection of each support block to the respective footing, whereby each support block may be moved along the respective footing from one end of the footing to a position under the respective manufactured home support beam before the support block is secured to the respective support beam and footing.

2. A foundation system as defined in claim 1 wherein each footing has a groove extending along the top surface thereof and the respective support blocks slidingly fit in said groove.

3. A foundation system as defined in claim 1 wherein each footing has a tongue extending along the top surface thereof and the respective support blocks have a groove in the lower surface thereof mating with the tongue of the respective footing.

4. A foundation system as defined in claim 3 wherein each groove has sidewalls tapering downwardly and inwardly, and that portion of the respective support block fitting in the respective groove has vertical sidewalls, characterized further to include grout in the spaces between the support block and the respective groove sidewalls.

5. A foundation system as defined in claim 2 wherein the ends of the footings are parallel with the sides of the manufactured home and extend outwardly from the sides of the manufactured home, and characterized further to include a support block positionally secured on the outer end portion of each footing.

6. A foundation system as defined in 5 claim characterized further to include at least one additional footing at each end of the manufactured home, and a support block positionally secured in each said additional footing, each said additional footing extending beyond the respective end of the manufactured home.

7. A foundation system as defined in claim 6 characterized further to include skirting secured to support blocks at the outer edges of the manufactured home, thereby enclosing the space under the manufactured home.

* * * * *

UNITED STATES PATENT AND TRADEMARK OFFICE

CERTIFICATE OF CORRECTION

PATENT NO. : 6,536,170 B2
DATED : March 25, 2003
INVENTOR(S) : Joseph H. Stuever It is certified that error appears in the above-identified patent and that said Letters Patent is hereby corrected as shown below:

Column 2,
Line 23, delete “eater” and substitute -- greater --;
Line 23, delete “ma factured” and substitute -- manufactured --.

Column 3,
Line 60, delete “shod” and substitute -- method --;
Line 60, delete “prezt” and substitute -- present --;

Column 5,
Line 6, delete “3” and substitute -- 2 --.

Column 6,
Line 3, delete “5 claim” and substitute -- claim 5 --.

Signed and Sealed this

Seventh Day of October, 2003

JAMES E. ROGAN
*Director of the United States Patent and Trademark Office*